United States Patent [19]

Ambrosini

[11] 4,043,269

[45] Aug. 23, 1977

[54] SEALED SABOT PROJECTILE

[75] Inventor: Leonard R. Ambrosini, Bettendorf, Iowa

[73] Assignee: The United States of America as represented by the Secretary of the Army, Washington, D.C.

[21] Appl. No.: 691,048

[22] Filed: May 27, 1976

[51] Int. Cl.[2] ..... F42B 13/34; F42B 13/16

[52] U.S. Cl. ..... 102/87; 102/93

[58] Field of Search ..... 102/52, 60, 87, 93

[56] References Cited

U.S. PATENT DOCUMENTS

| | | | |
|---|---|---|---|
| 3,348,485 | 10/1967 | Dufour | 102/52 |
| 3,498,222 | 3/1970 | Birkigt | 102/52 |
| 3,745,926 | 7/1973 | Mertz et al. | 102/93 |
| 3,780,658 | 12/1973 | Longueville et al. | 102/52 |

FOREIGN PATENT DOCUMENTS

| | | | |
|---|---|---|---|
| 1,260,881 | 4/1961 | France | 102/60 |
| 69,888 | 1/1929 | Sweden | 102/60 |
| 482,167 | 1/1970 | Switzerland | 102/52 |
| 432,201 | 1/1935 | United Kingdom | 102/60 |

*Primary Examiner*—Verlin R. Pendegrass

*Attorney, Agent, or Firm*—Nathan Edelberg; Robert O. Richardson

[57] ABSTRACT

A sealed sabot projectile wherein the rear centering ring of the sabot has an opening to expose the projectile tracer material to the propulsion gases. This opening has a seal over it with a small aperture therein for controlled flow of gases to ignite the tracer material yet avoid premature separation of the projectile from the rear spin generating portion of the sabot. The resulting greater spin velocity of the projectile gives it greater accuracy.

4 Claims, 9 Drawing Figures

SEALED SABOT PROJECTILE

GOVERNMENT RIGHTS

The invention described herein may be manufactured and/or used by or for the Government for governmental purposes without the payment of any royalty thereon.

BACKGROUND OF THE INVENTION

In armor-piercing ammunition, a very high velocity and stability of the projectile in flight are essential for the round to achieve its objective in terms of range, accuracy and target destruction. Stability of the projectile may be accomplished by different means, such as by adding fins, or, in the case of this invention, spinning the projectile above a predetermined angular velocity. Weight distribution, geometrical shape, and flight conditions contribute to the desired stability.

Conventional design includes a sabot carrying a subprojectile which is spun to the required angular velocity by means of a rotating band on the sabot engaging the rifled gun tube. This engagement causes the sabot and thus the subprojectile to rotate as they pass through the barrel of the gun. Difficulties have been encountered when a tracer is added to the subprojectile. The simplest method of igniting the tracer is by means of the hot propellant gases which launch the projectile. This requires a hole in the base of the sabot to expose the tracer material to the hot gases.

Using hot propellant gases to ignite the tracer unfortunately allows gases to penetrate between the subprojectile and the sabot. This has various adverse effects such as alteration of friction conditions, formation of a gas bearing between the two elements, blow-by of gases inside the round, or reduction of setback forces causing the subprojectile to be prematurely separated from the sabot. All of these can cause the subprojectile to fail to reach its critical spin rate, causing it to corkscrew or yaw. These undesirable flight characteristics result in not all ammunition firing at the same velocity or with the same degree of accuracy.

SUMMARY OF THE INVENTION

These problems and difficulties above mentioned are overcome by employment of the present invention which comprises a seal at the base of the sabot that will stop or reduce the gas flow between the sabot and the subprojectile. With regard to ignition of the tracer, an orifice in the seal permits gas to flow but only in metered amounts sufficient to ignite the tracer without effectively reducing the setback force or creating other damaging effects.

A first embodiment, made of aluminum, is semispherical in shape with a long tubular protrusion insertable within an orifice in the sabot for attachment. Production tolerances allow considerable variation in the size of the orifice in which the seal is inserted. The tubular portion is therefore slightly larger than the orifice of largest diameter and capable of deformation when driven into an orifice of smaller size. This insures a tight fit with any sabot having an orifice of any size within production tolerances.

The second embodiment is a polyethylene or polyurethane material disc-like in shape, with a protrusion to locate it over the orifice in the sabot. This protrusion may be threaded into the orifice or the disc may be fastened over the end of the sabot such as by bolts or by gluing. It must be sufficiently strong to withstand the propellant gas pressure, eventually taking support from the projectile tracer housing.

The third embodiment is a doughnut shaped rubber seal which fits within the orifice of the sabot and surrounds the base of the subprojectile to prevent the passing of propellant gases between it and the sabot.

BRIEF DESCRIPTION OF DRAWINGS

The above mentioned features and advantages of the present invention will become readily apparent from the following description, when considered in conjunction with the accompanying drawings wherein like reference numerals indicate the same or corresponding parts in the various figures and wherein:

FIG. 9 is a view similar to FIG. 7 showing the third embodiment seal installed.

DETAILED DESCRIPTION OF ILLUSTRATIVE EMBODIMENTS

Figure 1:
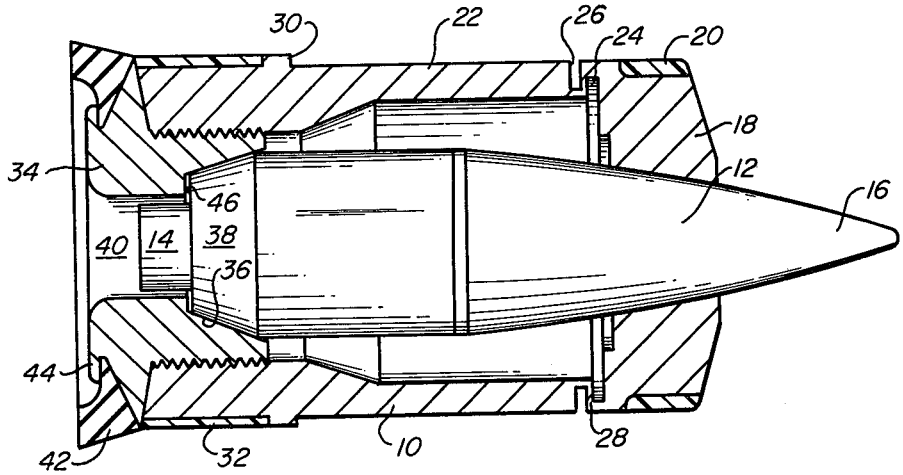
FIG. 1 is a cross sectional view of the sabot and subprojectile without a seal to show the problem of the gas flow therebetween.

Reference is now made to FIG. 1 which shows the sabot assembly 10 in section with a projectile 12 housed within. This projectile preferably is of tungsten carbide, tungsten alloy or similar heavy metal composition. It terminates rearwardly in an open ended cylinder 14 having a tracer material therein, now shown, which ignites under the influence of high energy propellant gas when the sabot is launched through a rifled gun tube, also not shown. The nose 16 of the projectile 12 extends through the front face 18 which has a nylon centering band 20 about its periphery. This face is integral with a cylindrical wall 22 housing the projectile 12. Inner and outer annular grooves 24, 26 in wall 22 provide a weak frangible collar 28 in between. Front face 18 is segmented so that it will fall away from the projectile 12 when it leaves the gun tube.

On the outer surface of wall 22 is an annular lip 30 that engages the gun tube rifling to spin the sabot at an adequate angular velocity. Rearwardly of this lip 30 is threadedly inserted a rotating band 32 of fiberous plastic material. This band rapidly wears helical grooves on its outer surface from the gun tube rifling as the sabot is launched.

After the projectile 12 has been inserted into the sabot, an annular centering ring 34 is threadedly inserted over it. This ring has a truncated conical inner surface 36 that bears against the truncated conical outer surface 38 at the end of projectile 12 to center the axis of projectile 12 on the axis of the sabot. The tracer cylinder 14 extends into opening 40 of ring 34 which is of larger diameter so that cylinder 14 will not interfere with the alignment of the projectile 12. An obturator 42, preferably of rubber or other resilient material, is mounted on the periphery of ring 34 to complete the assembly.

The sabot projectile just described and shown in FIG. 1 is conventional and depicts the state of the art prior to the present invention. Propellant gases bear against base 44 of ring 34 in launching the sabot. These gases also enter opening 40 and ignite the tracer material in cylinder 14. The front face 18 has broken away from wall 22 and pressure on the tracer cylinder 14 and pressure leakage around it and onto base surface 46 of projectile 12 breaks the contact between projectile surface 38 and ring surface 36. Thus, the full spinning force of the sabot is not imparted to the projectile.

Figure 2:
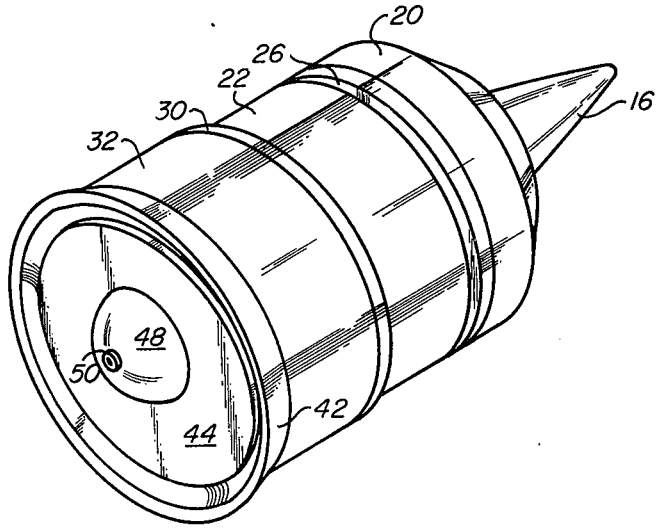
FIG. 2 is a perspective view of the sabot and subprojectile with the aluminum seal installed.
Figure 3:
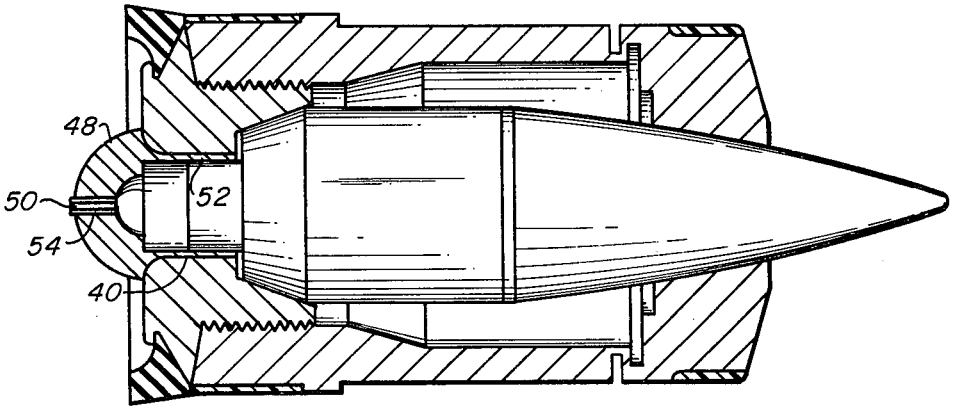
FIG. 3 is a cross sectional view of FIG. 2.
Figure 4:
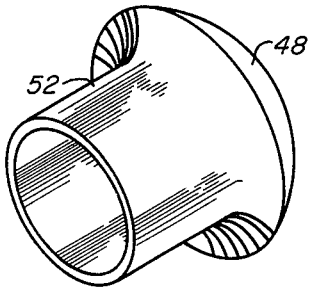
FIG. 4 is a perspective view of the seal of the first embodiment.

In FIG. 2 there is shown in perspective a sabot launchable armor piercing projectile of the type just described, but with a first modification of the present invention. Here is shown a semi-spherical capped seal 48 overlying the opening 40 and abutting the rear surface of ring 34. This seal has an orifice 50 therethrough for the controlled flow of propulsion gases into the tracer cylinder 14. As can be seen in FIGS. 3 and 4, this seal has a long tubular protrusion 52 that fits snugly within opening 40 of ring 34. When the seal is made of aluminum, a steel liner 54 surrounds orifice 50 to eliminate turn-through.

Figure 5:
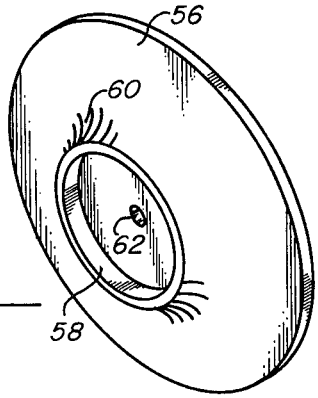
FIG. 5 is a perspective view of a second embodiment of the seal.
Figure 6:
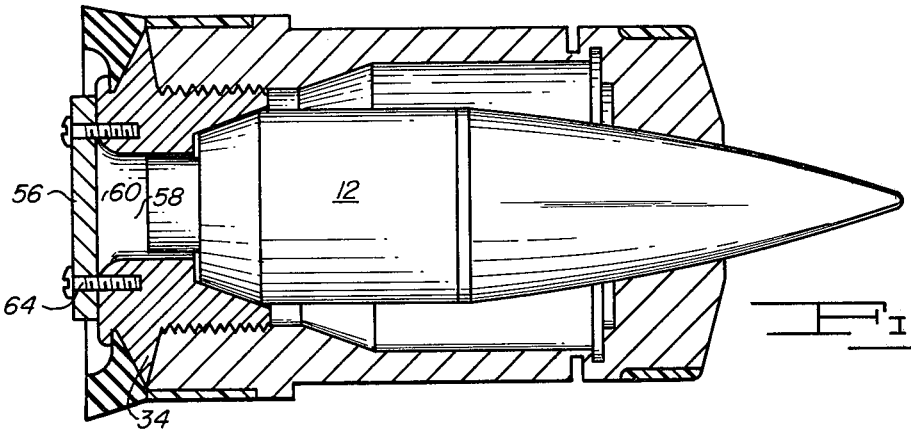
FIG. 6 is a view similar to FIG. 3, showing a second embodiment installed.

FIGS. 5 and 6 illustrate a second embodiment. FIG. 5 shows in perspective a flat disc-like seal 56 having an annular protrusion 58 adapted to fit within opening 40 of the sabot ring 34. A radial shoulder 60 between the disc-like surface and the protrusion seats against the mouth of the opening 40. Seal 56 also has an aperture 62 to permit gases to pass through to ignite the tracer material. As can be seen in FIG. 6, this seal 56 may be attached to ring 34 by means of screws 64. Gluing is also an acceptable method of attachment.

Figure 7:
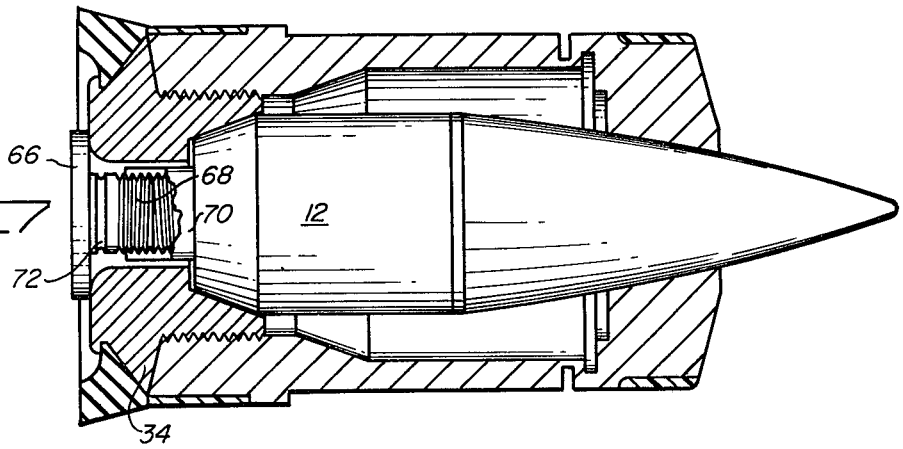
FIG. 7 is a view similar to FIG. 6 showing an alternate method of attaching the seal to the sabot.

The modification shown in FIG. 7 is similar to that shown in FIGS. 5 and 6 except that the disc seal 66 has a male threaded post 68 that mates with internal threads in the projectile tracer cylinder 70. A frangible annular groove 72 is provided on the post to enable separation of the projectile from the centering ring 34.

Figure 8:
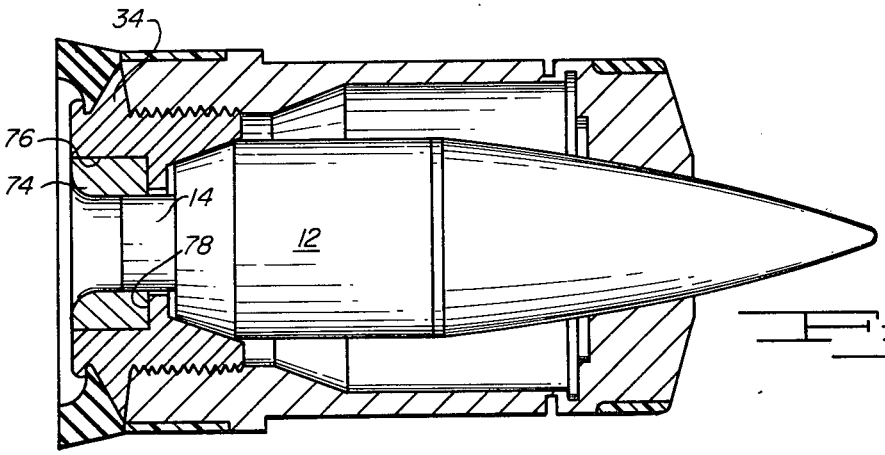
FIG. 8 is a perspective view of a third embodiment of the seal.
Figure 8:
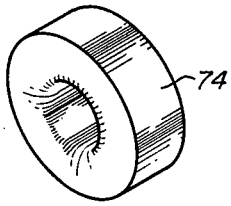

Another modification is shown in FIGS. 8 and 9. In this version a doughnut shaped rubber seal 74, shown in FIG. 8, is pressed within an enlarged portion 76 of the opening in ring 34 and seated against shoulder 78. It resiliently fits over the tracer cylinder 14 and does not interfere with the alignment of the projectile 12 by the centering ring 34.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A sealed sabot projectile comprising:

a sabot having a cylindrical wall and a front face with an opening for insertion of the nose of a projectile therethrough, a centering ring threadedly engagable with said wall and adapted to align and retain a projectile within said sabot, said ring having an opening therein to permit propulsion gases to impinge against said projectile in the separation thereof from said sabot, and a seal within said opening having an orifice therein for controlled flow of propulsion gases therethrough, said seal including a semi-spherical cap overlying said ring opening and a long tubular protrusion fitting snugly within said opening, said orifice extending through said cap.

2. A sealed sabot projectile as in claim 1 wherein a tracer cylinder is attached to the rear end of said projectile and tracer material therein is ignited by propulsion gases passing through said orifice.

3. A sealed sabot projectile as in claim 1, said orifice having a steel liner therein to eliminate burn-through.

4. A sealed sabot projectile as in claim 1 wherein said seal has a flat disc-like cover and a protrusion adapted to fit within said centering ring opening.

* * * * *